US011721920B2

(12) United States Patent
Doi

(10) Patent No.: US 11,721,920 B2
(45) Date of Patent: Aug. 8, 2023

(54) ELECTRICAL CONNECTOR FOR CIRCUIT BOARDS

(71) Applicant: Hirose Electric Co., Ltd., Kanagawa (JP)

(72) Inventor: Kentaro Doi, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/317,577

(22) Filed: May 11, 2021

(65) Prior Publication Data

US 2021/0359442 A1 Nov. 18, 2021

(30) Foreign Application Priority Data

May 15, 2020 (JP) ..... 2020-085926

(51) Int. Cl.
*H01R 12/71* (2011.01)
*H01R 13/631* (2006.01)
(Continued)

(52) U.S. Cl.
CPC ..... *H01R 12/716* (2013.01); *H01R 12/737* (2013.01); *H01R 12/91* (2013.01); *H01R 13/6315* (2013.01); *H01R 24/60* (2013.01)

(58) Field of Classification Search
CPC .... H01R 12/716; H01R 12/737; H01R 12/91; H01R 12/73; H01R 24/60; H01R 13/6315; H01R 13/26
(Continued)

(56) References Cited

U.S. PATENT DOCUMENTS 9,048,601 B2 * 6/2015 Kimura ..... H01R 24/60
9,917,403 B2 * 3/2018 Doi ..... H01R 12/716
(Continued)

FOREIGN PATENT DOCUMENTS

JP 2004-214091 A 7/2004
JP 2017-111918 A 6/2017
(Continued)

OTHER PUBLICATIONS

JP2018139229A_translation (Year: 2018).*
Office Action dated Apr. 26, 2023 for related JP Patent Application No. 2020-085926 and English translation, in 8 pages.

*Primary Examiner* — Marcus E Harcum
(74) *Attorney, Agent, or Firm* — Procopio, Cory, Hargreaves & Savitch LLP

(57) ABSTRACT

The movable housing has an entry wall portion that enters the interior space of the stationary housing; terminal holding grooves accommodating a portion of the resilient portions, which extend in the direction of connection to a counterpart connect body, are formed to be arranged in the terminal array direction on one wall surface of the entry wall portion; movable-side terminal holding portions securing the movable-side retained portions of the terminals are formed on the opposite side in the connector width direction perpendicular to said one wall surface; between adjacent terminal holding grooves. When the terminals are attached in the direction of connection from the circuit board side, the projections have gaps formed between them and the resilient portions of the terminals located within the terminal holding grooves in the terminal array direction.

3 Claims, 8 Drawing Sheets

(51) Int. Cl.
*H01R 12/73* (2011.01)
*H01R 12/91* (2011.01)
*H01R 24/60* (2011.01)

(58) Field of Classification Search
USPC ..... 439/630, 637, 74, 247, 248
See application file for complete search history.

(56) References Cited

U.S. PATENT DOCUMENTS

| | | | | |
|---|---|---|---|---|
| 10,062,995 | B2 | 8/2018 | Doi | |
| 10,608,361 | B2 * | 3/2020 | Teruki | H01R 13/506 |
| 2015/0044901 | A1 * | 2/2015 | Doi | H01R 12/716 439/592 |
| 2015/0132976 | A1 * | 5/2015 | Sato | H01R 12/73 439/74 |
| 2018/0048083 | A1 * | 2/2018 | Doi | H01R 12/91 |
| 2018/0198234 | A1 * | 7/2018 | Takane | H01R 13/6315 |
| 2018/0287301 | A1 * | 10/2018 | Tanaka | H01R 4/028 |
| 2019/0020134 | A1 * | 1/2019 | Suzuki | H01R 12/55 |
| 2019/0334288 | A1 * | 10/2019 | Horii | H01R 12/727 |
| 2020/0052440 | A1 * | 2/2020 | Hashiguchi | H01R 12/716 |
| 2020/0127410 | A1 * | 4/2020 | Shioda | H01R 12/91 |
| 2020/0176930 | A1 * | 6/2020 | Shioda | H01R 13/502 |
| 2020/0313327 | A1 * | 10/2020 | Morita | H01R 24/60 |
| 2020/0412038 | A1 * | 12/2020 | Yoshida | H01R 12/716 |

FOREIGN PATENT DOCUMENTS

| | | | | | |
|---|---|---|---|---|---|
| JP | 2018139229 | A | * | 9/2018 | H01R 12/7005 |
| JP | 2018-174022 | A | | 11/2018 | |
| JP | 2019-071191 | A | | 5/2019 | |
| JP | 2020-068082 | A | | 4/2020 | |

* cited by examiner

Z1
Z2
Z
X
X1
X2
Y
Y1
Y2
I
II
20
30
40
41
50
71
10
11
31
32
32B
33
34
34A
34B
35
30A
42
46
60
70
72
75
80

ELECTRICAL CONNECTOR FOR CIRCUIT BOARDS

CROSS-REFERENCE TO RELATED APPLICATIONS

This application claims priority to Japanese Patent Application No. 2020-085926, filed May 15, 2020, the contents of which are incorporated herein by reference in its entirety for all purposes.

BACKGROUND

Technical Field

The present invention relates to an electrical connector for circuit boards that is mounted to a circuit board.

Related Art

Such an electrical connector for circuit boards has been disclosed, for instance, in Patent Document 1. The electrical connector for circuit boards according to Patent Document 1, which is a so-called floating connector, has a stationary housing, which is attached to a circuit board, and a movable housing, to which a counterpart connector is matingly connected and which is capable of moving relative to the stationary housing, and multiple terminals (referred to as "socket contacts" in Patent Document 1) are arranged and attached so as to span the distance between the stationary housing and the movable housing. The terminals have a curved resilient portion (referred to as a "displacement portion" in Patent Document 1) formed in the intermediate portion of said terminals in the longitudinal direction, which enables the movable housing to move relative to the stationary housing as a result of resilient deformation of said resilient portions.

At one end, the terminals have connecting portions (referred to as "terminal portions" in Patent Document 1), which extend from the stationary housing and are solder-connected to a circuit board, and, at the other end, contact portions (referred to as "contact terminal portions" in Patent Document 1), which are disposed in the movable housing and can be placed in contact with terminals in the counterpart connector (counterpart terminals). Further, the total length of the resilient portion, i.e., the spring length, is increased and a considerable degree of floating of the movable housing is ensured by virtue of the fact that the resilient portion is formed such that a substantially U-shaped upper curved portion is located in the upper portion of said resilient portion.

In addition to undergoing resilient deformation in the connector width direction, which is a direction perpendicular to the terminal array direction and the connector height direction (the direction perpendicular to the circuit board), the resilient portion is also subject to resilient deformation in the terminal array direction. According to Patent Document 1, the movable housing is provided with projections that are push-fitted between the upper curved portions of the resilient portions of adjacent terminals, which prevents inadvertent solder ball penetration between adjacent upper curved portions from the outside.

PATENT DOCUMENTS

[Patent Document 1]

Japanese Patent Application Publication No. 2018-174022.

SUMMARY

Problems to be Solved

As described above, according to Patent Document 1, projections located so as to be push-fitted between the upper curved portions of the resilient portions of adjacent terminals are provided in the movable housing in order to prevent inadvertent solder ball entry. These projections serve to restrict excessive resilient deformation of the resilient portions of the terminals in the terminal array direction. Specifically, whenever the connector vibrates and generates resonance in some of the multiple terminals, excessive resilient deformation of the resilient portions in the terminal array direction is restricted by the projections. As a result, contact between the resilient portions of adjacent terminals is prevented.

Although Patent Document 1 makes no specific mention of the step of attachment of the terminals to the housing, a state in which a gap is formed between the terminals and the movable housing is depicted at least for the movable housing, and, therefore, it is believed that the terminals are inserted and incorporated from below at least into the movable housing.

According to Patent Document 1, an upper curved portion is formed at the top of the resilient portion and the projections formed in the upper portion of the movable housing are downwardly push-fitted between the upper curved portions of adjacent terminals. Consequently, during the step of incorporation of the terminals into the movable housing, the upper curved portions of the resilient portions of the terminals, that is, the terminals incorporated from under the movable housing, enter between adjacent projections immediately prior to the completion of incorporation. Thus, as a result, upon completion of incorporation, the projections end up located between the resilient portions (between the upper curved portions) of adjacent terminals.

However, it is believed that since the resilient portions of the terminals are curved and elongated in the direction of incorporation, i.e., longitudinally, and readily undergo resilient deformation, during the incorporation step, their orientation is unstable, and, in particular, the position of the upper curved portions in the terminal array direction is not fixed, such that immediately prior to the completion of incorporation, the crests of the upper curved portions end up colliding with the projections of the movable housing and cannot enter between adjacent projections. In addition, if the upper curved portions undergo a degree of plastic deformation due to collision with the projections, it may sometime be impossible to perform smooth incorporation even with repeated incorporation attempts.

In view of the aforesaid circumstances, it is an object of the present invention to provide an electrical connector for circuit boards that allows for easy and reliable incorporation of terminals with resilient portions and makes it possible for contact between the terminals to be prevented even if the resilient portions undergo considerable resilient deformation.

Technical Solution

It is an object of the invention to provide an electrical connector for circuit boards that allows for easy and reliable incorporation of terminals with resilient portions and makes it possible for contact between terminals to be prevented even if the resilient portions undergo considerable resilient deformation.

The inventive electrical connector for circuit boards has terminals with connecting portions intended for connecting to a circuit board formed at one end and contact portions intended for contacting a counterpart connect body formed at the other end, and a housing with multiple terminals secured therein such that the terminal array direction is a direction parallel to the surface of the circuit board; said housing has a stationary housing, which is intended for attachment to the circuit board via the connecting portions of the terminals, and a movable housing, which is capable of moving relative to said stationary housing and has the contact portions of the terminals disposed therein; and the stationary housing has an interior space formed to permit entry of the movable housing in the direction of connection to the counterpart connect body.

According to the present invention, such an electrical connector for circuit boards is characterized by the fact that the terminals have a stationary-side retained portion secured in the stationary housing by press-fitting, a movable-side retained portion secured in the movable housing by press-fitting, and a resiliently deformable resilient portion located between said stationary-side retained portion and said movable-side retained portion; the movable housing has an entry wall portion that enters the interior space of the stationary housing and is located in a spaced-apart relationship with said stationary housing; terminal holding grooves, which extend in the direction of connection and are used for accommodating portions of the resilient portions, are formed and arranged in the terminal array direction on one wall surface of said entry wall portion; movable-side terminal holding portions, which secure the movable-side retained portions of the terminals in place, are formed on the back side, that is, the opposite side in the connector width direction perpendicular to the one wall surface; and, furthermore, between adjacent terminal holding grooves, the movable housing has projections that extend in the direction of connection from the distal end portion facing the circuit board side of the entry wall portion; and, when the terminals are attached in the direction of connection from the circuit board side, gaps are formed between the projections and the resilient portions of the terminals located within the terminal holding grooves in the terminal array direction.

In the thus-configured invention, in the movable housing, the terminals are inserted and incorporated into the terminal holding grooves from the entrance side of said terminal holding grooves where projections are located on the circuit board side, i.e., on the distal end side of the entry wall portion. Consequently, during the insertion and incorporation step, portions of the resilient portions naturally enter between the projections located on opposite sides of the terminal holding grooves, and the resilient portions, guided by said projections, easily and reliably enter all the way to a predetermined incorporation position. Furthermore, once the terminals have been inserted and incorporated, on the one hand, the resilient portions are enabled for resilient deformation in the terminal array direction within the bounds of the gaps between them and the projections, and on the other hand, there is no contact between terminals because excessive resilient deformation is precluded by the projections.

In the present invention, the resilient portions of the terminals have a wavelike configuration with multiple curved portions in the space between the stationary housing and the movable-side terminal holding portions of the movable housing, and the curved portions located closest to the movable-side terminal holding portions in the connector width direction can be located farthest from the circuit board in the direction of connection.

When a resilient portion has multiple curved portions, the curved portion that is farthest from the mating portion undergoes the greatest resilient deformation. Therefore, excessive resilient deformation of the resilient portions can be efficiently restricted by the projections if the curved portions that are farthest from the mating portion are positioned closest to the movable-side terminal holding portions in the connector width direction.

In the present invention, the movable housing can be adapted to have terminal holding grooves and projections formed also on the distal end face of the distal end portion facing the circuit board, with the projections on the distal end face protruding beyond the terminals towards the circuit board. In this manner, the terminals located within the terminal holding grooves of the distal end portion of the entry wall portion are positioned inward of the projections, and, therefore, the terminals do not abut the circuit board even if the movable housing is displaced in the direction of connection towards the circuit board.

Technical Effect

In this manner, in the present invention, in view of the fact that the terminals are incorporated from the distal end side of the entry wall portion of the movable housing, the projections are formed between the terminal holding grooves so as to extend from the distal end portion of said entry wall portion in the direction of connection, and, for this reason, terminals with resilient portions can be incorporated in an easy and reliable manner, and, upon incorporation, contact between terminals can be prevented even if some terminals tend to undergo considerable resilient deformation in the terminal array direction.

BRIEF DESCRIPTION OF DRAWINGS

FIG. 1(A) illustrates a state prior to mating, and FIG. 1(B) illustrates a state after mating.

FIGS. 2 (A) and 2(B) illustrate perspective cross-sectional views illustrating cross-sections of the plug connector and the receptacle connector of FIGS. 1(A) and 1(B) taken in a plane perpendicular to the terminal array direction, where

DETAILED DESCRIPTION

Embodiments of the present invention are described below with reference to the accompanying drawings.

First Embodiment

The plug connector I according to the present embodiment illustrated in FIGS. 1(A), 1(B), 2(A), and 2(B) is an electrical connector for circuit boards mounted to the mounting face of a circuit board (not shown). The receptacle connector II, which serves as a counterpart connect body (counterpart connector) of the plug connector I, is an electrical connector for circuit boards mounted to the mounting face of another circuit board (not shown). For ease of understanding of directions, in the following drawings illustrating the present embodiment, the connector height direction Z is the up-down direction perpendicular to the mounting face of the circuit board, Y is the terminal array direction of the connector, and X is the connector width direction, i.e., a direction perpendicular to both the connector height direction Z and the terminal array direction Y. The plug connector I and the receptacle connector II are disengageably matingly connected such that the mounting faces of the circuit boards are oriented parallel to one another and the direction of connection is the connector height direction Z (upward Z1 and downward Z2) perpendicular to the mounting faces. In the present embodiment, the receptacle connector II is adapted to be matingly connected to the plug connector I along the downward Z2-axis.

The plug connector I comprises: multiple metal plug terminals 10, which are arranged such that the terminal array direction Y (Y1 and Y2) is a direction parallel to the mounting face of the circuit board; a plug housing 20 made of an electrically insulating material (e.g., plastic), in which the multiple plug terminals 10 are secured in place; and metal plug anchor fittings 50, which are secured in place at both ends of the plug housing 20 in the terminal array direction Y. As can be seen in FIGS. 2(A, B) and FIG. 3, the plug terminals 10 are arranged in two rows. The two rows of plug terminals 10 have a mutually symmetrical configuration in the connector width direction X and are opposed in a symmetrical orientation.

Figure 4:
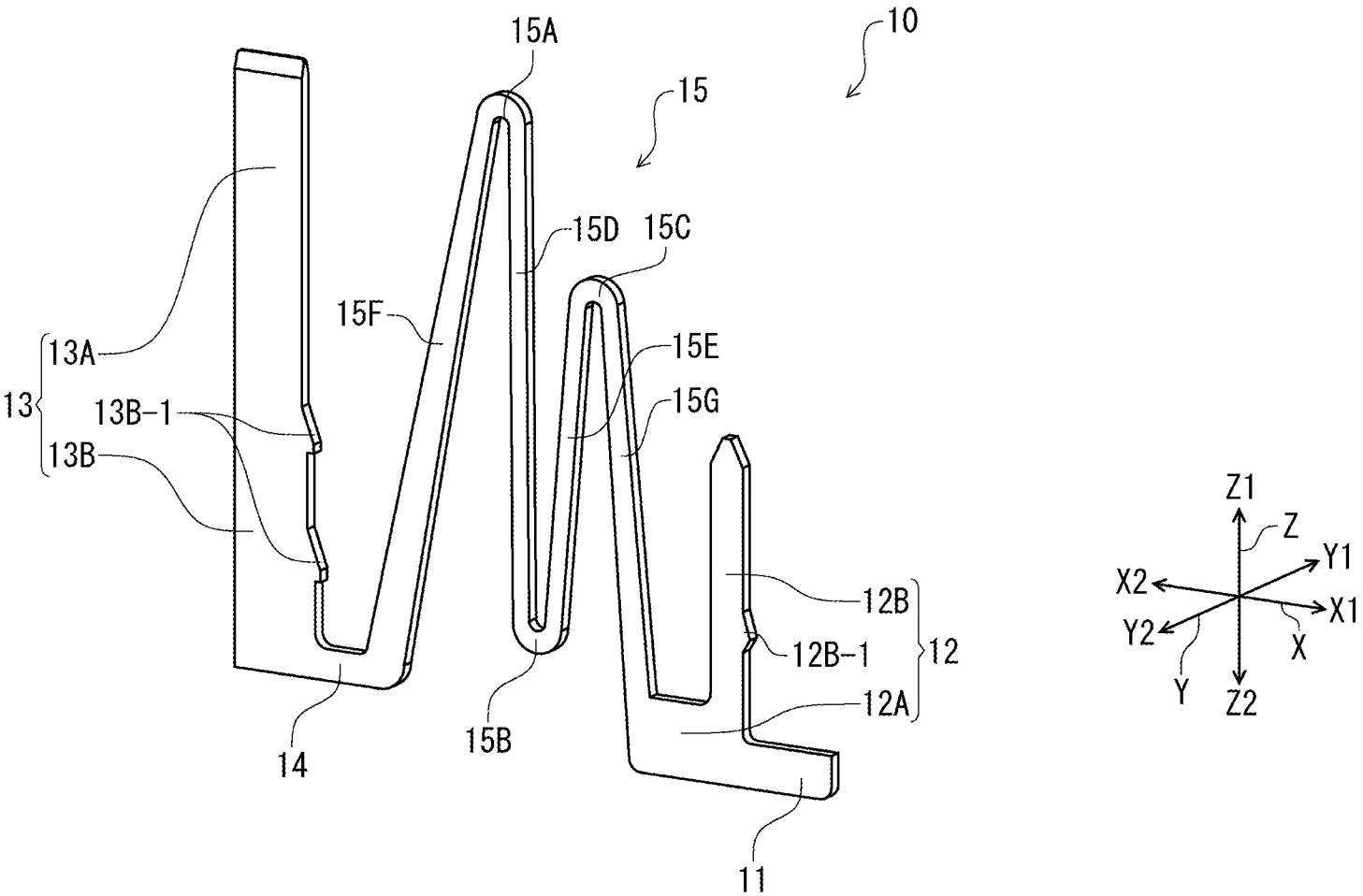
FIG. 4 illustrates a perspective view of a single plug terminal of the plug connector of FIGS. 1(A) and 1(B).

FIG. 4 is an oblique view of a single plug terminal 10. As can be seen in FIG. 4, the plug terminals 10, which are illustrated by a single terminal taken from one of the two rows, are male terminals made by punching a sheet metal member in the through-thickness direction while maintaining a flat surface and are provided with curved sections located within this flat surface. The terminals have a connecting portion 11, a stationary-side retained portion 12, a contact portion 13A, a movable-side retained portion 13B, a movable-side coupling portion 14, and a resilient portion 15.

The connecting portion 11, which is formed at one end of the plug terminal 10 so as to extend in the connector width direction X, has its bottom end solder-connected to the corresponding circuits on the mounting face of the circuit board. The stationary-side retained portion 12 is located upwardly of the connecting portion 11 and has a base portion 12A, which is attached to the connecting portion 11, and a retained arm portion 12B, which extends from said base portion 12A in a rectilinear manner along the upward Z1-axis on the external side (side X1 in FIG. 4) of the base portion 12A in the connector width direction X. The retained arm portion 12B has formed therein a retained projection 12B-1 that protrudes from the side edge portion (edge portion extending in the connector height direction Z) located on the external side in the connector width direction X (side X1 in FIG. 4). The retained arm portions 12B are press-fitted from below into groove-shaped stationary-side terminal holding portions 31C provided in the stationary housing 30, which will be described below, and are secured in the stationary housing 30 by virtue of the fact that the stationary-side retained projections 12B-1 are brought into biting engagement with the interior wall surface of the stationary-side terminal holding portions 31C.

The contact portion 13A is formed at the other end of the plug terminal 10 (in FIG. 4, the farthest end in the X2 direction) in the upper portion of the arm portion 13, which extends in a rectilinear manner in the connector height direction Z. The contact portion 13A is adapted to be clamped on both major faces perpendicular to the terminal array direction Y with a pair of contact pieces 62A provided in a receptacle terminal 60, which will be described below, and thereby brought into contact with said pair of contact pieces 62A. The movable-side retained portion 13B, which constitutes the bottom portion of the arm portion 13 and is located below the contact portion 13A, has formed therein two movable-side retained projections 13B-1 protruding from the side edge portion (edge portion extending in the connector height direction Z) located on the external side in the connector width direction X (side X1 in FIG. 4). In addition, the movable-side retained portion 13B has a movable-side coupling portion 14, which extends outwardly in the connector width direction X (X1 direction) from the side edge portion of its bottom portion and is coupled to a resilient portion 15. The movable-side retained portions 13B are press-fitted along the upward Z1-axis into pass-through groove-shaped movable-side terminal holding portions 43A provided in the movable housing 40, which will be described below, and the movable-side retained projections 13B-1 are brought into biting engagement with the interior wall surface of the movable-side terminal holding portions 43A, which prevents decoupling from the movable housing 40.

The resilient portion 15, which emerges from the base portion 12A and the movable-side coupling portion 14, has a general configuration that is substantially M-shaped. The resilient portion 15 has a strip-like configuration whose width is narrower than that of the retained arm portion 12B and the movable-side retained portion 13B. In addition to having two curved portions 15A, 15C of a curved shape at the top and a single curved portion 15B of a curved shape at the bottom, the resilient portion 15 has an inner long arm portion 15D, which connects the curved portion 15A and the curved portion 15B, and an inner short arm portion 15E, which connects the curved portion 15C and the curved portion 15B, and, in addition, an outer long arm portion 15F, which connects the curved portion 15A and the movable-side coupling portion 14, and an outer short arm portion 15G, which connects the curved portion 15C and the base portion 12A. In the present embodiment, the inner long arm portion 15D and the outer long arm portion 15F are of substantially the same length, and the inner short arm portion 15E and the outer short arm portion 15G are of substantially the same length. In addition, due to the fact that the inner long arm portion 15D and the outer long arm portion 15F are longer than the inner short arm portion 15E and outer short arm portion 15G, as can be seen in FIG. 4, the curved portion 15A is located above the curved portion 15C. In the resilient portion 15, the curved portion 15A, which is located highest, i.e., farthest from the circuit board in the connector height direction Z, is located inwardly in the connector width direction X, i.e., closest to the movable-side retained portion 13B of the arm portion 13.

The resilient portion 15 has a substantially M-shaped configuration obtained by coupling three wavelike portions, i.e., an inverted U-shaped wavelike portion whose top end is the curved portion 15A, a U-shaped wavelike portion whose bottom end is the curved portion 15B, and an inverted U-shaped wavelike portion whose top end is the curved portion 15C. In the three wavelike portions, there are formed widening sections sloping in such a manner that the opening width of the wedge becomes wider as the mutually adjacent arm portions, i.e., the inner long arm portion 15D and the outer long arm portion 15F, the inner long arm portion 15D and the inner short arm portion 15E, and the inner short arm portion 15E and the outer short arm portion 15G, get farther away from the curved portion 15A, curved portion 15B, or curved portion 15C.

The resilient portion 15 is resiliently deformable due to the fact that the arm portions 15D, 15E, 15F, and 15G, which are mutually adjacent in the connector width direction X, are displaced such that the gaps therebetween, in other words, the widening sections, are expanded and contracted using the curved portions 15A, 15B, and 15C as fulcrums. In addition, the resilient portion 15 is also resiliently deformable in its through-thickness direction, that is, in the terminal array direction Y and, in addition, is resiliently deformable in the connector height direction Z. In the present embodiment, as discussed before, the resilient portion 15 is made substantially M-shaped, thereby increasing the total length of the resilient portion 15, that is, the entire length of the resilient portion 15 along its substantially M-shaped configuration, thereby making it possible to resiliently deform the resilient portion 15 with sufficient spring length.

As can be seen in FIGS. 1(A), 1(B), 2(A), and 2(B), the plug housing 20, when viewed in the connector height direction Z, with the terminal array direction Y being the longitudinal direction and the connector width direction X being the lateral direction, has a stationary housing 30, which is used for attachment to a circuit board via the plug terminals 10, and a movable housing 40, which is formed as a member separate from the stationary housing 30, can move relative to the stationary housing 30, and has the contact portions 13A of the plug terminals 10 disposed therein.

The stationary housing 30 has a pair of side walls 31, which are positioned so as to be opposed in the connector width direction X and extend in the terminal array direction Y, and a pair of end walls 32, which extend in the connector width direction X and couple the end portions of the pair of side walls 31, and perimeter walls constituting a square cylinder are formed by the pair of side walls 31 and the pair of end walls 32. The space within the perimeter walls, which is enclosed by the pair of side walls 31 and the pair of end walls 32 and extends in the connector height direction Z, has formed therein an interior space 30A used for accommodating the movable housing 40 from below (see also FIG. 3).

Figure 2B:
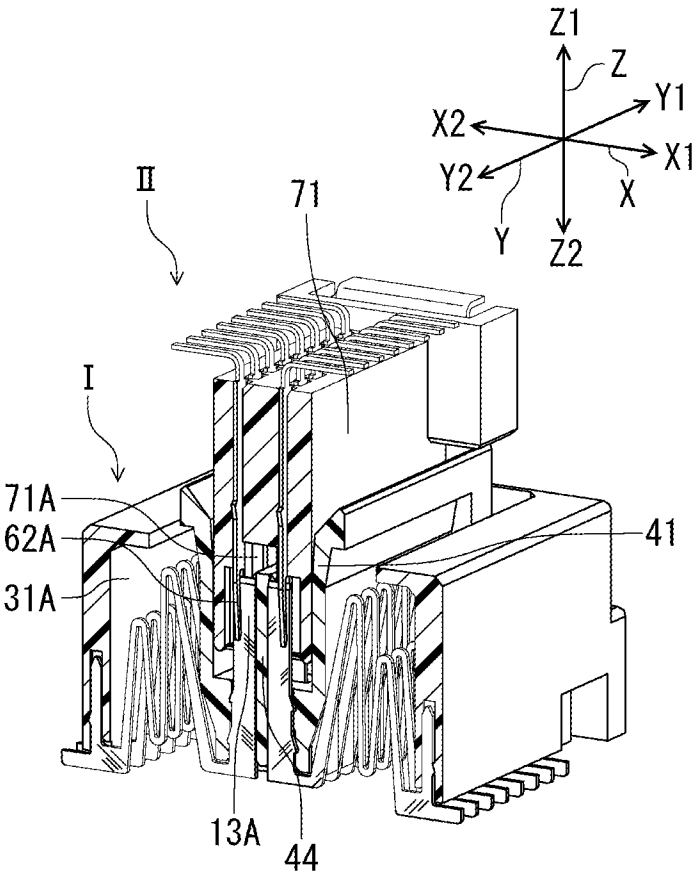
FIG. 2(B) illustrates a state after mating.
Figure 2A:
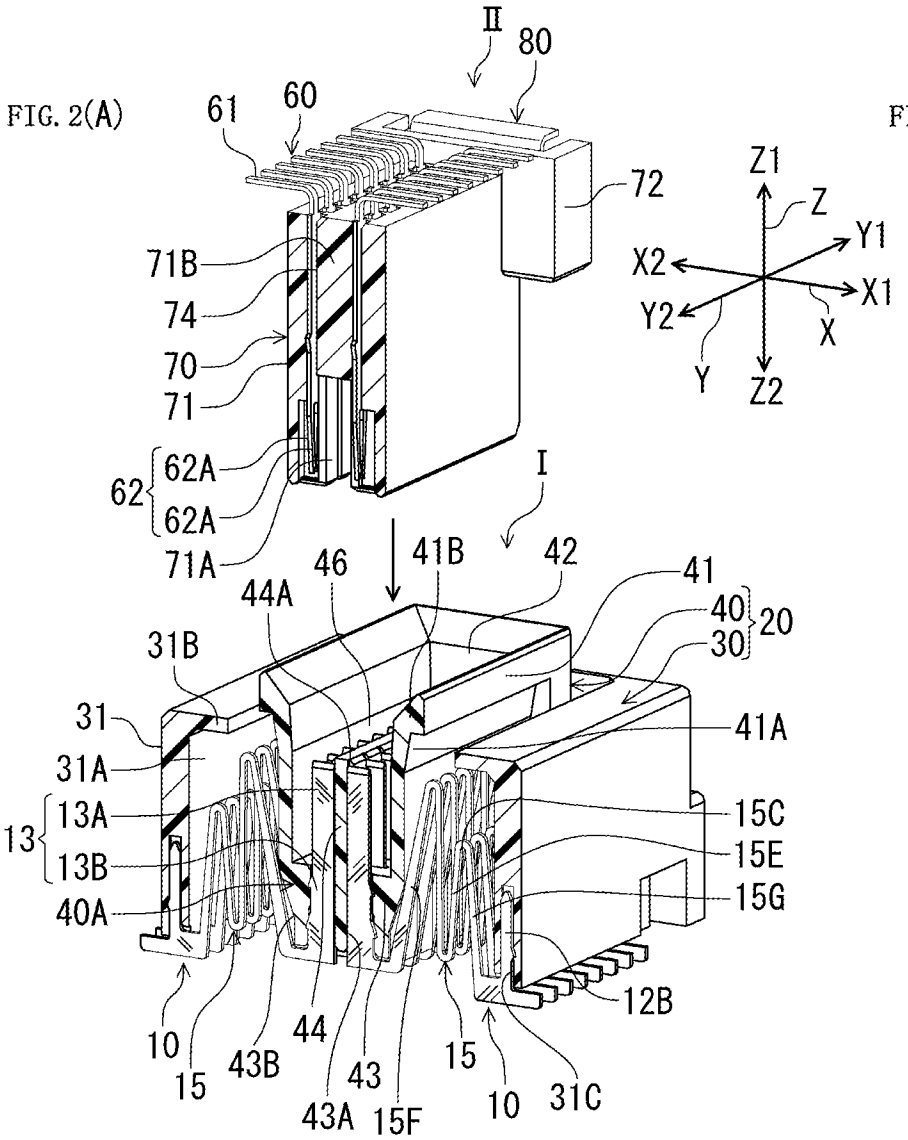
FIG. 2(A) illustrates a state before mating.

A stationary-side receiving portion 31A used for accommodating a portion of the resilient portions 15 of the plug terminals 10 is formed in the side walls 31 by recessing the interior wall surface of the side walls 31 while extending in the connector height direction Z (see FIG. 2(A)). The stationary-side receiving portion 31A, which extends in the connector height direction Z within a range extending from a location proximate to the top end of the side walls 31 to the bottom end, has its top end sealed by a protruding upper edge 31B and has its bottom end left open. As can be seen in FIG. 2(A), when the resilient portions 15 of the plug terminals 10 are in a free state, the stationary-side receiving portion 31A accommodates the inner short arm portions 15E, curved portions 15C, and outer short arm portions 15G of the resilient portions 15. In addition, groove-shaped stationary-side terminal holding portions 31C, which are used for securing the retained arm portions 12B of the plug terminals 10 in place via press-fitting, are formed in the bottom half of the side walls 31 at locations corresponding to the plug terminals 10 in the terminal array direction Y in a slit-shaped configuration which, while extending in the connector height direction Z, is downwardly open and extends at a right angle with respect to the terminal array direction Y (see FIG. 2(A), FIG. 5(A), and FIG. 5(B)).

Figures 1A, 1B:
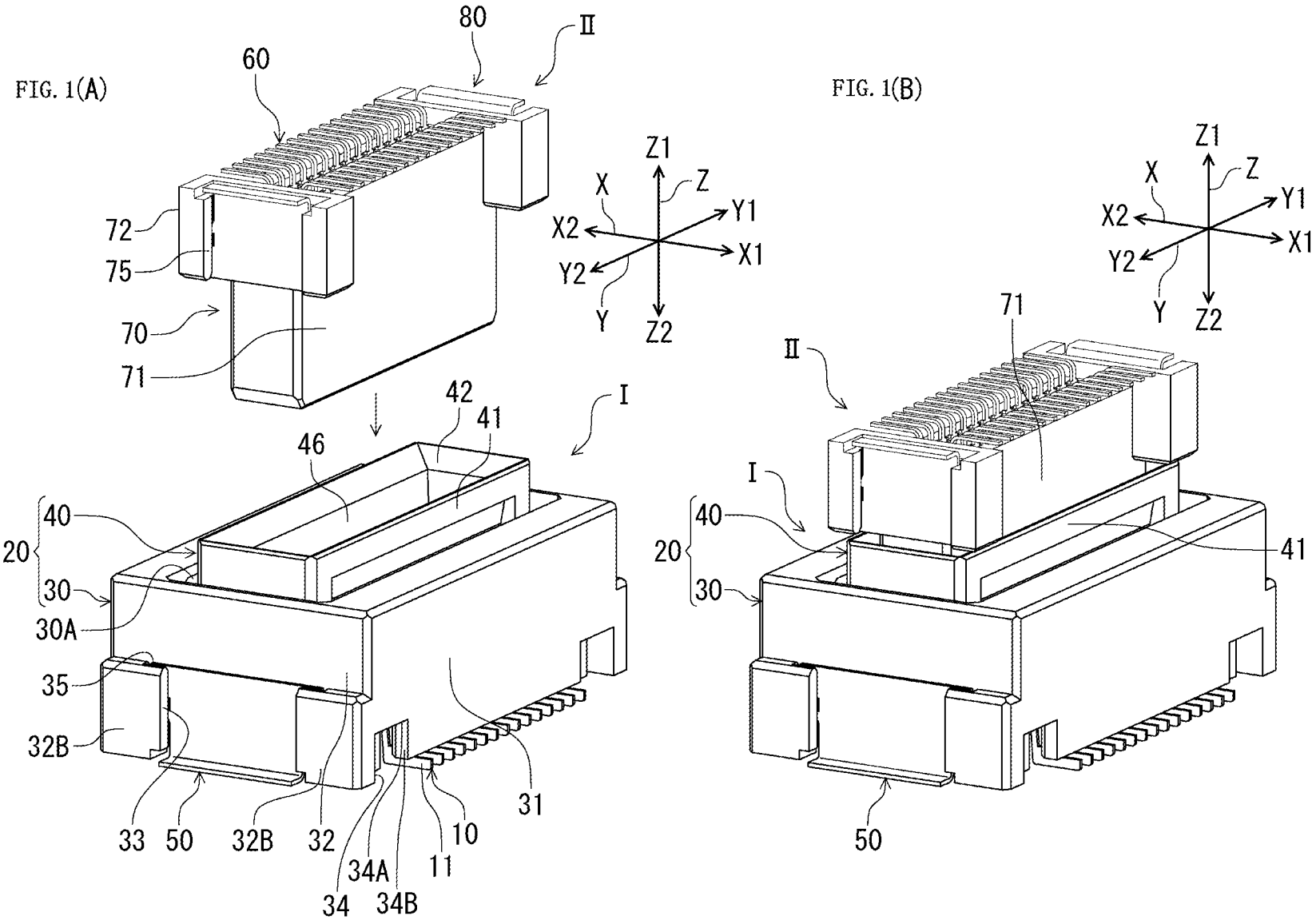
FIGS. 1(A) and 1(B) illustrate perspective views of a plug connector and a receptacle connector according to a first embodiment of the invention, where

As can be seen in FIG. 1(A), protruding walls 32B with two thick sections are formed on opposite sides in the connector width direction X in the bottom half of the end wall 32. In addition, the gaps between the two protruding walls 32B are formed as fitting press-fit receiving portions 33, and slit-shaped fitting insertion grooves 35 are formed at the inner edges of the protruding walls 32B in the connector width direction X so as to extend through the wall thickness in the connector height direction Z. Plug anchor fittings 50, which will be described below, are secured by press-fitting in these fitting press-fit receiving portions 33.

Figure 5B:
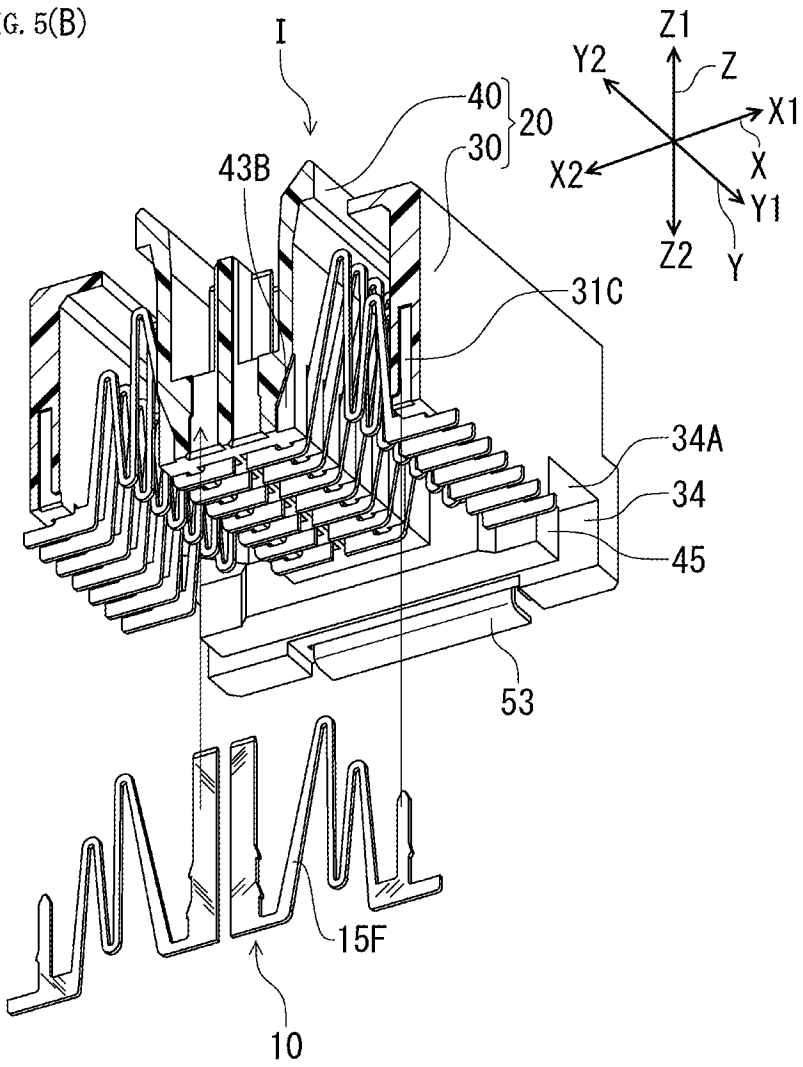
FIG. 5(B) illustrates a view showing a state in which a pair of plug terminals have been removed from the plug connector of FIG. 5(A).
Figure 5A:
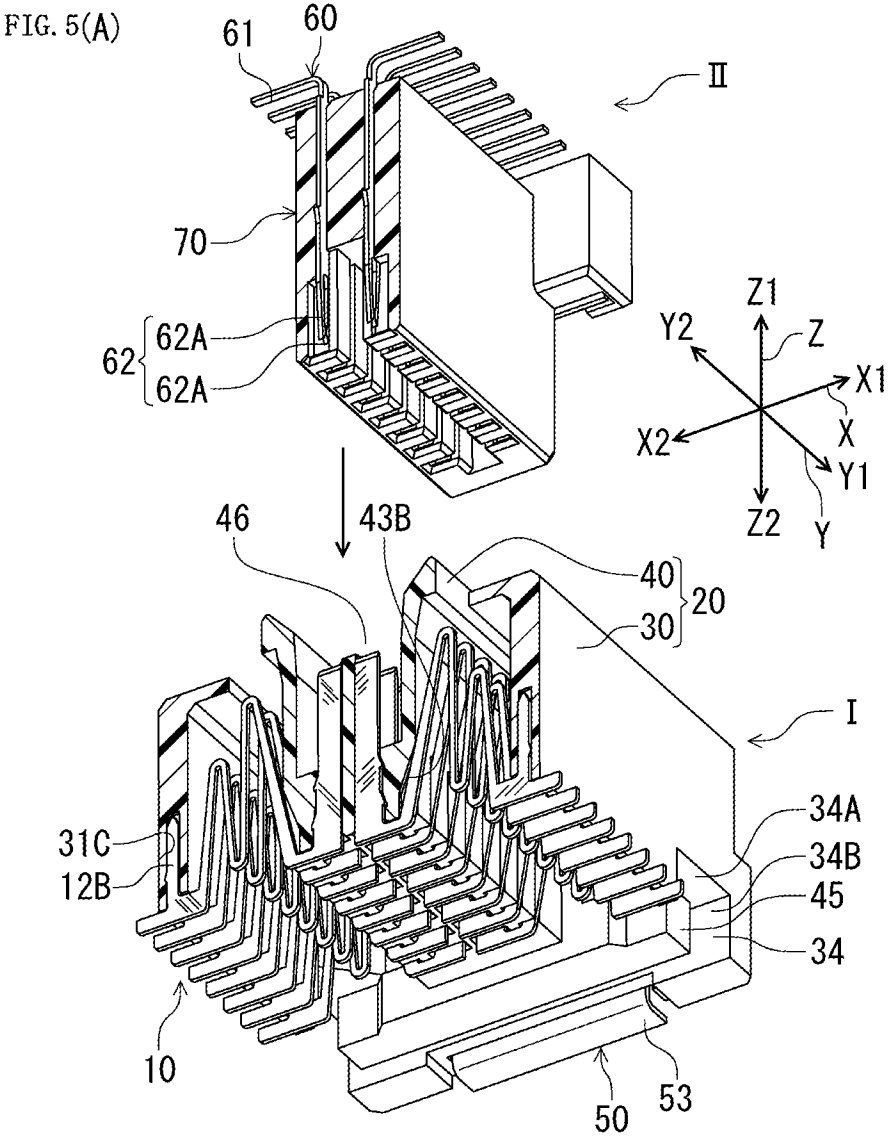
FIG. 5(A) illustrates a perspective cross-sectional view taken at the location of the terminals, in which the plug connector and the receptacle connector illustrated before mating in FIG. 2(A) are viewed from below.

In addition, as can be seen in FIG. 1(A) and FIGS. 5(A) and 5(B), restricting groove portions 34, which are downwardly open and extend in the connector width direction X, are formed in the side walls 31 at locations proximate to the protruding walls 32B of the end walls 32. Restricted portions 45 (see FIGS. 5(A) and 5(B)), to be described below, which are provided in the movable housing 40, are accommodated in the restricting groove portions 34, and the upper inner surface of the restricting groove portions 34 forms upper restricting faces 34A opposed to the restricted portions 45. In addition, their lateral inner surfaces form lateral restricting faces 34B facing the restricted portions.

The movable housing 40 is inserted and disposed inside the interior space 30A of the stationary housing 30 from below. As can be seen in FIG. 2(A), most of the movable housing 40, except for the top end portion of the movable housing 40 and the restricted portions 45, which will be described below, forms an entry wall portion 40A movably held within the interior space 30A of the stationary housing 30. The top end portion of the movable housing 40 forms a section that is above the entry wall portion 40A and, as can be seen in FIG. 2(A), is located so as to protrude above the interior space 30A of the stationary housing 30.

As can be seen in FIG. 2(A), the entry wall portion 40A has a pair of long walls 41, which extend in the terminal array direction Y and in the connector height direction Z, a pair of short walls 42, which extend in the connector width direction X and in the connector height direction Z and couple the end portions of the pair of long walls 41, a thick bottom wall 43, which seals the space enclosed by the perimeter walls made up of the pair of long walls 41 and the pair of short walls 42 from below, and an upstanding wall 44, which upstands from the bottom wall 43 and extends in the terminal array direction Y. The space enclosed by the perimeter walls and upwardly open in the connector height direction Z constitutes a receiving portion 46 for receiving a portion of the hereinafter-described housing main body portion 71 of the receptacle connector II. Substantially in its bottom half, the receiving portion 46 forms an annular space defined between the perimeter walls and the upstanding wall 44.

The long walls 41 have their exterior wall surface recessed within a range comprising the terminal array range, thereby forming a movable-side receiving portion 41A used for accommodating a portion of the resilient portions 15 of the plug terminals 10. The movable-side receiving portion 41A, which extends in the up-down direction within a range extending from a location proximate to the top end of the long walls 41 to the bottom end, has its top end sealed by a protruding upper edge 41B and its bottom end left open. As can be seen in FIG. 2(A), when the resilient portions 15 of the plug terminals 10 are in a free state, the movable-side receiving portion 41A accommodates the outer long arm portions 15F of the resilient portions 15.

Figure 6B:
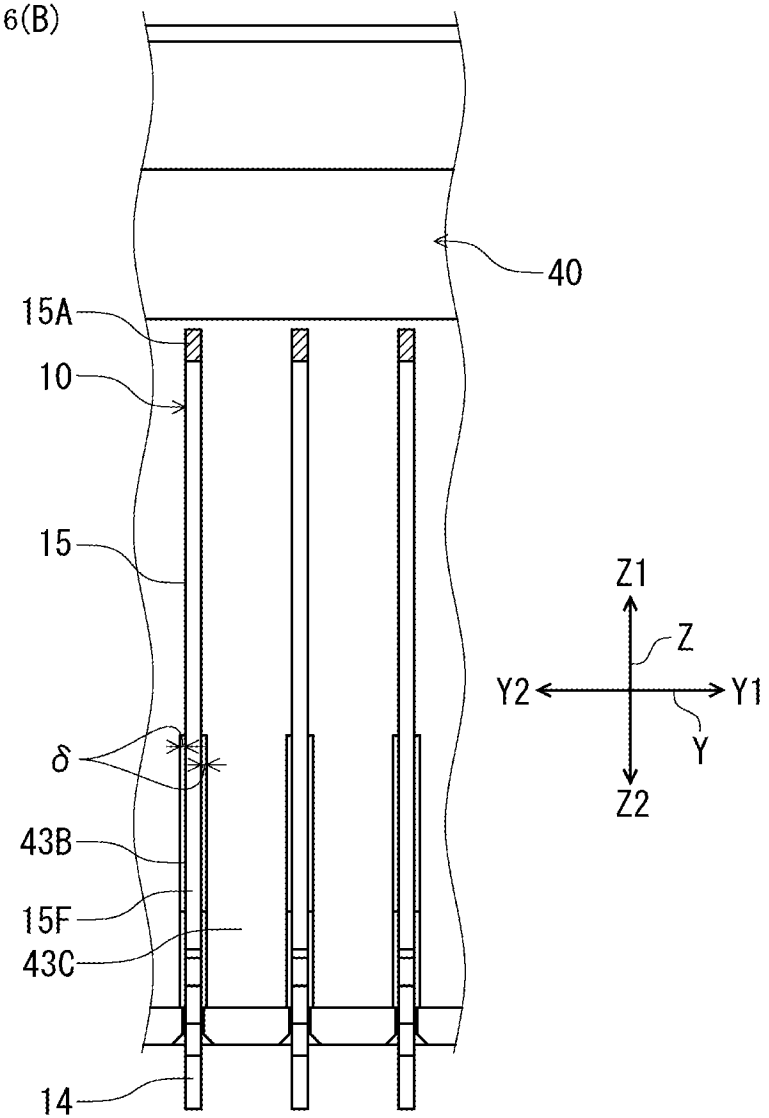
FIG. 6(B) illustrates a cross-sectional view of the plug connector of FIG. 6(A), as viewed in the connector width direction.
Figure 6A:
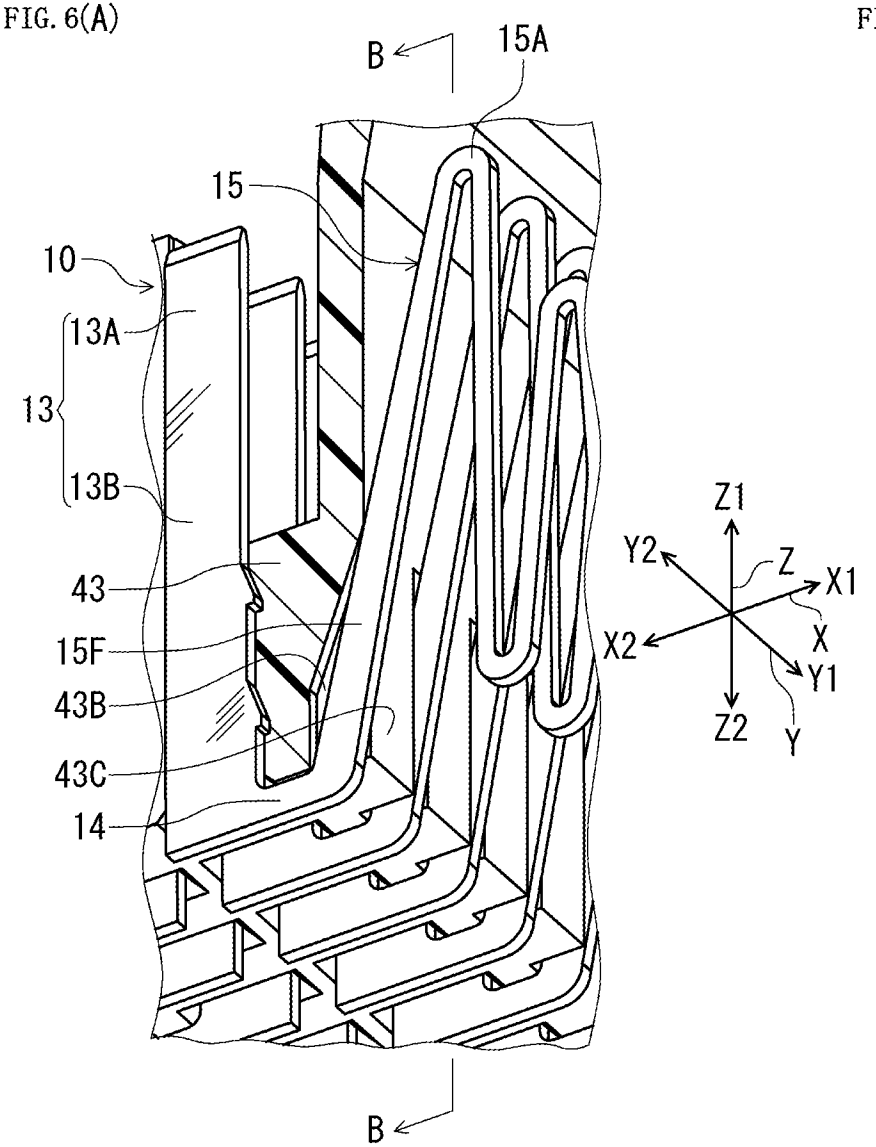
FIG. 6(A) illustrates an enlarged perspective cross-sectional view of an essential portion of the plug connector of FIG. 5(A)

In the bottom wall 43, pass-through groove-shaped movable-side terminal holding portions 43A, which receive the movable-side retained portions 13B of the plug terminals 10 and secure them in place via press-fitting, are formed and arranged in the terminal array direction Y. The movable-side terminal holding portions 43A have a slit-shaped configuration oriented at a right angle with respect to the terminal array direction Y and extend in the up-down direction. In addition, as can be seen in FIG. 6(A), terminal holding grooves 43B used for movably accommodating the bottom portions of the outer long arm portions 15F of the resilient portions 15 are formed in the thick bottom wall 43 on the exterior wall surface facing the resilient portions 15 of the plug terminals 10 in the connector width direction X (see also FIG. 6(B)). Projections 43C, which are positioned so as to enter between the outer long arm portions 15F of the resilient portions 15 of adjacent plug terminals 10, are formed between terminal holding grooves 43B adjacent in the terminal array direction Y. As can be seen in FIG. 6(B), gaps 6 are formed in the terminal array direction Y between the projections 43C and the outer long arm portions 15F.

As far as the upstanding wall 44 is concerned, as can be seen in FIG. 2(A), inner groove portions 44A used for accommodating the side edge portions of the contact portions 13A of the plug terminals 10 are recessed into the side faces of the upstanding wall 44 (faces perpendicular to the connector width direction X) and are formed to extend in the connector height direction Z. At the bottom ends thereof, the inner groove portions 44A, which extend in the connector height direction Z, are in communication with the movable-side terminal holding portions 43A of the bottom wall 43.

Figure 3:
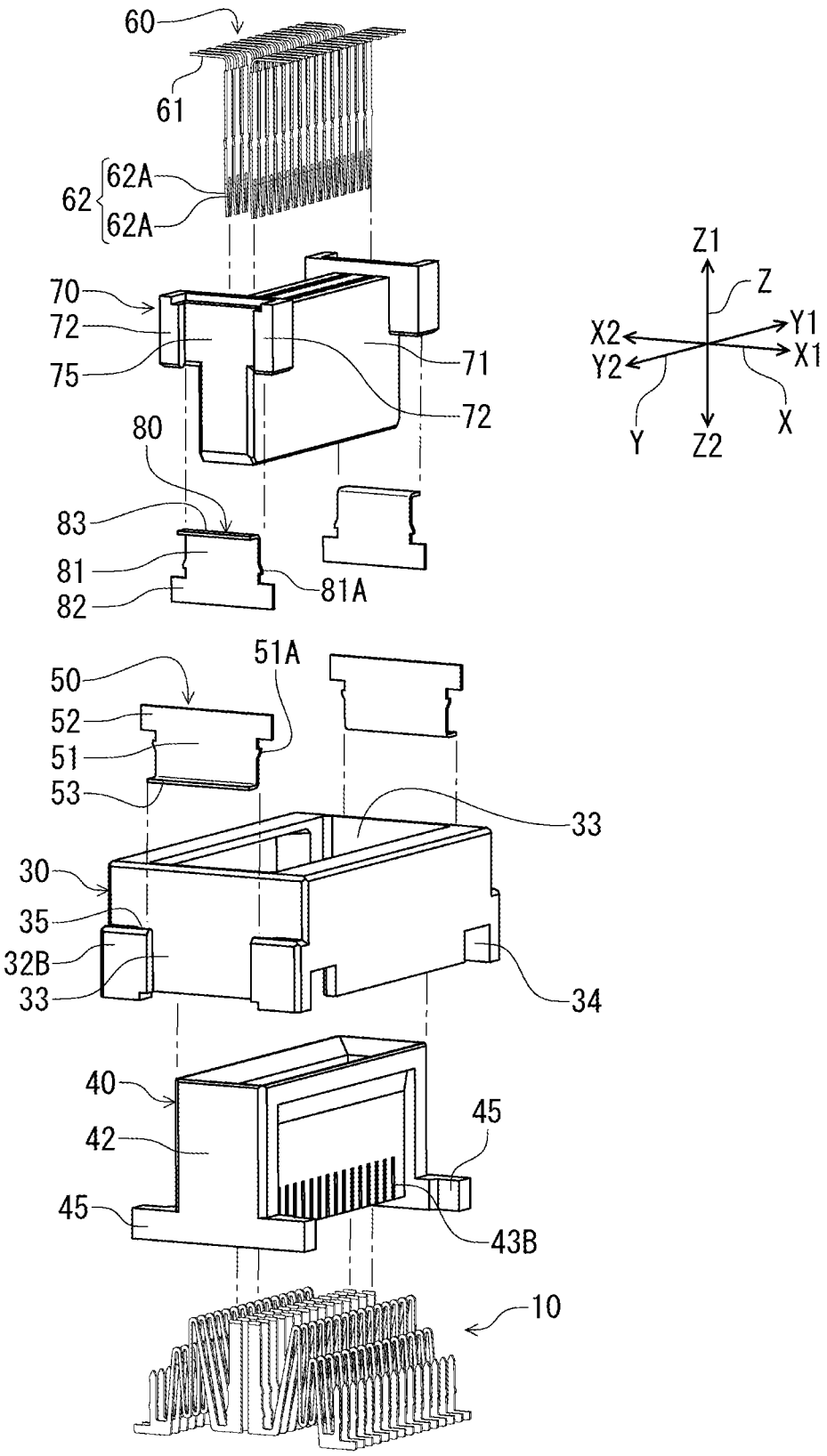
FIG. 3 illustrates a perspective view illustrating the components of the plug connector of FIGS. 1(A) and 1(B) in a separated state.

As can be seen in FIG. 3, the restricted portions 45 protrude outwardly from the bottom portion of the short walls 42 of the movable housing 40 in the connector width direction X. As can be seen in FIGS. 5(A) and 5(B) the restricted portions 45 have an angular cross-section and are accommodated in the restricting groove portions 34 of the stationary housing 30. In the connector height direction Z, the restricted portions 45 are in an opposed spaced-apart relationship with the upper restricting faces 34A of the restricting groove portions 34, and, in the terminal array direction Y, are in an opposed spaced-apart relationship with the lateral restricting faces 34B of the restricting groove portions 34. Therefore, while the movable housing 40 is enabled for upward movement within the bounds of the gap between the upper restricting faces 34A and the restricted portions 45, movement in excess thereof is restricted by abutment of the restricted portions 45 with the upper restricting faces 34A. In addition, while the movable housing 40 is enabled for movement in the terminal array direction Y within the bounds of the gap between the lateral restricting faces 34B and the restricted portions 45, movement in excess thereof is restricted by abutment of the restricted portions 45 with the lateral restricting faces 34B.

The plug anchor fittings 50 are made by partially bending a sheet metal member and, as can be seen in FIG. 3, have a main plate portion 51, which extends in a plane perpendicular to the terminal array direction Y, a protruding portion 52, which protrudes from the upper portion of the main plate portion 51 in the connector width direction X, and a leg portion 53, which is bent at the bottom edge of the main plate portion 51 and faces outwardly in the terminal array direction Y. Engagement projections 51A are formed on the side edges of the main plate portion 51.

The main plate portions 51 of such plug anchor fittings 50 are press-fitted from above into the fitting press-fit receiving portions 33 formed in the end walls 32 of the stationary housing 30 and secured in place by virtue of the fact that the engagement projections 51A formed in the main plate portions 51 are brought into biting engagement with the interior wall surface of the fitting insertion grooves 35, which prevents decoupling of the plug anchor fittings 50. As shown in FIG. 1(A), when the plug anchor fittings 50 are press-fitted to a predetermined position in the fitting press-fit receiving portions 33, the leg portions 53 are positioned at the level of the mounting face (not shown) of the circuit board in the connector height direction Z and can be brought into surface contact with the corresponding portions on the mounting face.

Next, the configuration of the receptacle connector II will be discussed with reference to FIG. 1(A) to FIG. 3. As can be seen in FIG. 1(A) to FIG. 3, the receptacle connector II comprises: multiple metal receptacle terminals 60, which are arranged such that the terminal array direction Y is a direction parallel to the mounting face (not shown) of the circuit board used for the receptacle connector II; a receptacle housing 70 made of an electrically insulating material (e.g., plastic), in which the multiple receptacle terminals 60 are held; and metal receptacle anchor fittings 80, which are secured in place at both ends of the receptacle housing 70 in the terminal array direction Y. The receptacle terminals 60 are arranged in 2 rows and are opposed in a mutually symmetrical orientation in the connector width direction X.

The receptacle terminals 60, which are fabricated by bending a strip-shaped sheet metal member in the through-thickness direction, have formed therein, at one end, a connecting portion 61 that is solder-connected to the mounting face (not shown) of the circuit board, and, at the other end, a contact portion 62 having a pair of contact pieces 62A that have a bifurcated configuration and are brought into contact with the contact portion 13A of the plug terminals 10 by clamping (see FIGS. 1(A) and 1(B)). The contact pieces 62A, which are strip-like pieces whose major faces extend in a direction perpendicular to the terminal array direction Y, are resiliently deformable in the terminal array direction Y, that is, in the direction of expansion and contraction of the gap of a pair of contact pieces 62A. When the connectors are mated, the pairs of contact pieces 62A are brought into contact with the plate-shaped contact portions 13A of the plug terminals 10 by clamping said contact portions 13A. The receptacle terminals 60 are attached by press-fitting from above (side Z1) into the hereinafter-described terminal receiving portions 74 formed in the receptacle housing 70 (see FIG. 2(A)).

The receptacle housing 70 comprises a housing main body portion 71, which extends in the connector height direction Z, and blocking portions 72, which protrude in the connector width direction X from the ends of the upper portion (section on side Z1) of the housing main body portion 71 in the terminal array direction Y. The housing main body portion 71 has a substantially rectangular parallelepiped-like exterior configuration whose longitudinal direction is the terminal array direction Y.

As can be seen in FIGS. 2(A) and 2(B), a receiving portion 71A, which is recessed in the central area in the connector width direction X and opens downwardly (in the Z2 direction), is formed in the bottom half of the housing main body portion 71. As can be seen in FIG. 2(B), the receiving portion 71A is adapted to receive the upstanding wall 44 of the movable housing 40 of the plug connector I from below when the connectors are in a mated state.

Terminal receiving portions 74, which accommodate the receptacle terminals 60, are formed in the housing main body portion 71 so as to be arranged in the terminal array direction. The terminal receiving portions 74, which extend across the full extent of the housing main body portion 71 in the connector height direction Z, have formed therein, within the bounds of the receiving portion 71A in the connector height direction Z, groove portions extending along the interior wall surface thereof, and, within the bounds of the solid bottom wall portion 71B that constitutes the bottom half (top half in FIG. 2(A)) in the connector height direction Z, aperture portions extending through the bottom wall portion 71B.

As can be seen in FIG. 3, fitting press-fit receiving portions 75 used to accommodate receptacle anchor fittings 80 are formed between the interior wall surfaces of the blocking portions 72 opposed in the connector width direction X. Slit-shaped fitting insertion grooves (not shown in FIG. 3), which are open downwardly in the connector height direction Z as well as inwardly in the connector width direction X within the wall thickness of the bottom portion (section excluding the top end portion) in the connector height direction Z in FIG. 3, are formed in the respective blocking portions 72.

The receptacle anchor fittings 80, which are made by partially bending a sheet metal member and, as can be seen in FIG. 3, are of the same shape as the plug anchor fittings 50, have a main plate portion 81, which extends in a plane perpendicular to the terminal array direction Y, protruding portions 82, which protrude from the bottom portion of the main plate portion 81 in the connector width direction X, and a leg portion 83, which is bent at the upper edge of the main plate portion 81 and faces outwardly in the terminal array direction Y. Engagement projections 81A are formed on the side edges of the main plate portion 81.

The main plate portions 81 of such receptacle anchor fittings 80 are press-fitted from below into the fitting press-fit receiving portions 75 formed in the end portions of the housing main body portion 71 and secured in place by virtue of the fact that the engagement projections 81A formed in the main plate portions 81 are brought into biting engagement with the interior wall surface of the fitting insertion grooves, which prevents decoupling of the receptacle anchor fittings 80. As shown in FIG. 1(A), when the receptacle anchor fittings 80 are press-fitted to a predetermined position in the fitting press-fit receiving portions 75, the leg portions 83 are positioned at the level of the mounting face of the circuit board in the connector height direction Z and can be placed into surface contact with the corresponding portions on the mounting face.

The procedure of assembly of the plug connector I used in the present embodiment configured as described above and the procedure of connection of the receptacle connector II to the plug connector I will be described next.

<Assembly Procedure for Plug Connector I>

First, in the plug connector I, the movable housing 40, as can be seen in FIG. 3, is positioned under the stationary housing 30 and is then introduced and placed in the stationary housing 30 from below.

Next, the plug terminals 10 are incorporated into the stationary housing 30 and the movable housing 40 from below. At such time, the arm portions 13 of the plug terminals 10 are press-fitted into the movable-side terminal holding portions 43A of the movable housing 40 from below and thus incorporated into the movable housing 40. Once the arm portions 13 have been incorporated, the side edge portions of the contact portions 13A forming the upper portions of the arm portions 13 are held in place by the movable-side terminal holding portions 43A of the upstanding wall 44. In addition, the movable-side retained portions 13B forming the bottom portions of the arm portion 13 are held in place by virtue of the fact that the movable-side retained projections 13B-1 are brought into biting engagement with the interior groove surface of the movable-side terminal holding portions 43A, which prevents decoupling of the plug terminals 10 (see FIG. 2(A)). On the other hand, the stationary-side retained portions 12 of the plug terminals 10 are press-fitted into the slit groove-shaped stationary-side terminal holding portions 31C of the stationary housing 30 from below and thus incorporated into the movable housing 40. At such time, the stationary-side retained portions 12 are held in place by virtue of the fact that the stationary-side retained projections 12B-1 are brought into biting engagement with the interior groove surface of the stationary-side terminal holding portions 31C, which prevents decoupling of the plug terminals 10 (see FIG. 2(A)).

Once the plug terminals 10 have been incorporated into the stationary housing 30 and the movable housing 40, the top halves of the outer short arm portions 15G, curved portions 15C, and inner short arm portions 15E of the resilient portions 15 are received in the stationary-side receiving portions 31A, and the outer long arm portions 15F of the resilient portions 15 are received within the movable-side receiving portion 41A. In addition, the bottom halves of the outer short arm portions 15G are received within the movable-side terminal holding portions 43A. In addition, the movable-side coupling portions 14 are exposed and extend along the bottom face of the bottom wall 43. The connecting portions 11 are exposed and extend along the bottom face of the side walls 31.

Further, during the step of press-fitting the arm portions 13 of the plug terminals 10 into the movable-side terminal holding portions 43A of the movable housing 40, the resilient portions 15 are introduced into the space formed between the stationary-side receiving portion 31A and the movable-side receiving portion 41A from below. In the process of entry into said space, the bottom halves of the outer long arm portions 15F of the resilient portions 15 (sections on the side coupled to the movable-side coupling portions 14) are inserted into the terminal holding grooves 43B of the movable housing 40 from below. At such time, the bottom halves of the outer long arm portions 15F are inserted into the terminal holding grooves 43B while being restricted in the terminal array direction Y by the interior wall surfaces of the terminal holding grooves 43B, in other words, by the exterior wall surfaces of the projections 43C (surfaces perpendicular to the terminal array direction Y)

located on opposite sides of the terminal holding grooves 43B in the terminal array direction Y. Therefore, the resilient portions 15, guided in such a manner that the bottom halves of the outer long arm portions 15F are restricted by the projections 43C, easily and reliably enter the space and reach the predetermined incorporation position.

In the present embodiment, the terminal holding grooves 43B used to guide the insertion of the resilient portions 15 are formed in the bottom wall 43 located in the movable housing 40 on the bottom side, that is, on the side where the plug terminals 10 are inserted in the connector height direction Z. Therefore, the relative position of the resilient portions 15 and the terminal holding grooves 43B can be easily set to the normal position in the early steps of the process of incorporation of the plug terminals 10, and the orientation of the resilient portions 15 can be stabilized in a simple and easy manner by inserting the bottom halves of the outer long arm portions 15F into the terminal holding grooves 43B.

In addition, since the resilient portions 15 of the plug terminals 10 are curved and large in the connector height direction Z, i.e., long in the direction of incorporation of the plug terminals 10, in a free state, they easily undergo resilient deformation in the terminal array direction Y and their orientation during the incorporation step is unstable, and, in particular, the position of the curved portions 15A located in front (above) in the direction of incorporation is difficult to set in the terminal array direction Y. On the other hand, since the bottom halves of the outer long arm portions 15F are coupled to the arm portions 13 held in the movable housing 40 via the movable-side coupling portions 14, they are more rigid compared to the curved portions 15A, and their orientation is unlikely to be unstable. Accordingly, since their orientation is unlikely to be unstable, the bottom halves of the outer long arm portions 15F can be readily inserted into the terminal holding grooves 43B. Therefore, situations in which the orientation of conventional resilient portions becomes unstable and they fail to stay in place are unlikely to occur in the present embodiment. Moreover, in the terminal holding grooves 43B, gaps 6 are formed between the resilient portions 15 of the plug terminals 10 and the projections 43C of the movable housing 40, which facilitates the incorporation of the plug terminals 10 and, upon incorporation, when the connector is in use, makes it possible to ensure floating based on resilient displacement of the resilient portions 15 within the gaps 6.

Although in the present embodiment the press-fitting of the arm portions 13 of the plug terminals 10 and the press-fitting of the stationary-side terminal holding portions 31C is performed simultaneously, the timing of press-fitting does not necessarily have to be simultaneous. For example, the movable housing 40 and the stationary housing 30 may be disposed at locations different from the locations illustrated in FIG. 2(A) in the connector height direction Z and, in addition, the press-fitting of the arm portions 13 and the press-fitting of the stationary-side terminal holding portions 31C may be performed one after the other.

Next, after incorporating the plug terminals 10 into the stationary housing 30 and the movable housing 40, the plug anchor fittings 50 are attached to the stationary housing 30. The attachment of the plug anchor fittings 50 to the stationary housing 30 may be performed at any time regardless of the incorporation of the plug terminals 10 into the stationary housing 30 and the movable housing 40.

On the other hand, as can be seen in FIG. 3, the receptacle connector II is completed by incorporating receptacle terminals 60 into the receptacle housing 70 from above and incorporating receptacle anchor fittings 80 from below.

<Procedure for Connecting Receptacle Connector II to Plug Connector I>

The plug connector I and the receptacle connector II are each attached to the corresponding circuit boards.

Subsequently, the housing main body portion 71 of the receptacle connector II is inserted into the receiving portion 46 of the movable housing 40 of the plug connector I. The housing main body portion 71 of the receptacle connector II is guided by the inner surface of the receiving portion 46 and the insertion proceeds while, at the same time, the upstanding wall 44, on which the plug terminals 10 (contact portions 13A) of the plug connector I are disposed, enters the receiving portion 71A of the housing main body portion 71 from below. As a result, the receptacle terminals 60 held in the housing main body portion 71 of the receptacle connector II clamp the contact portions 13A of the plug terminals 10 arranged on the upstanding wall 44 of the plug connector I with the bifurcated contact pieces 62A to establish contact with said contact portions 13A, and the two connectors are brought to a state of mated connection.

Figure 7:
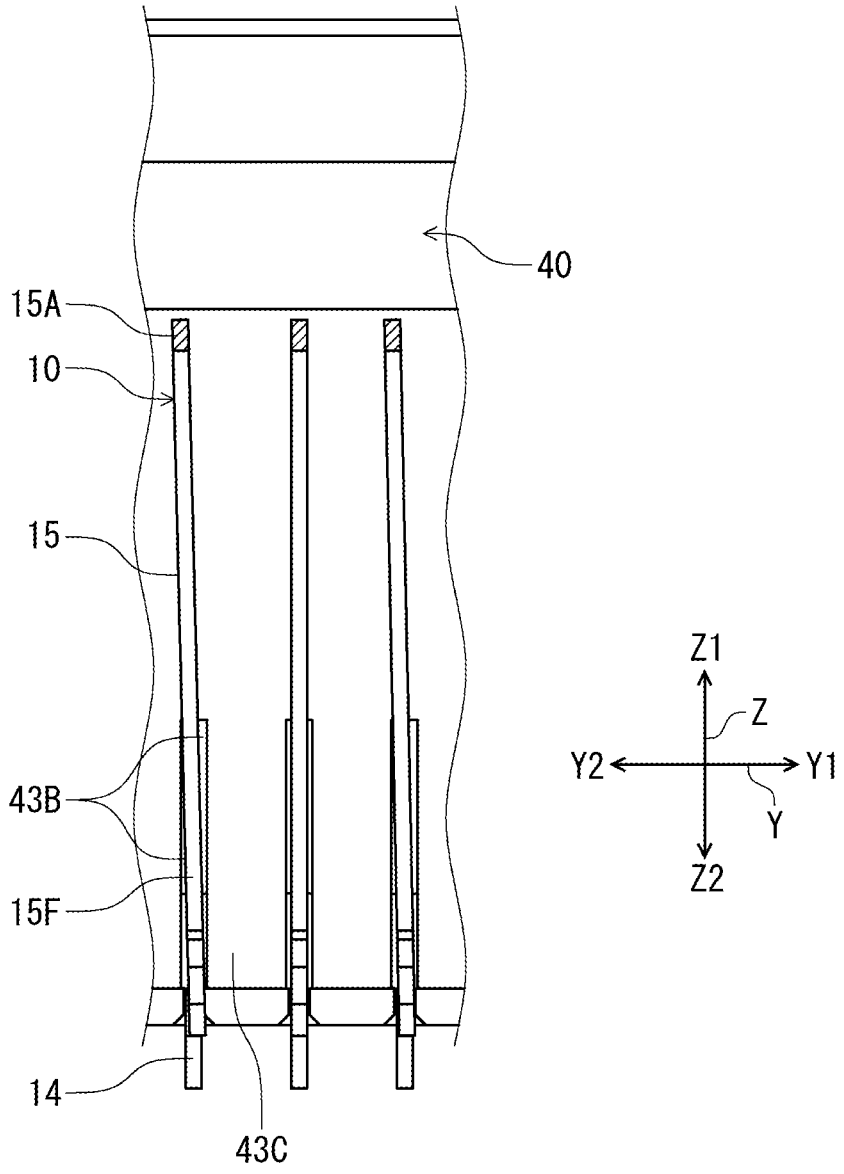
FIG. 7 illustrates a view corresponding to FIG. 6(B) that shows the resilient portions of the plug terminals in a resiliently displaced state.

Sometimes, the receptacle connector II and the plug connector I may not be connected precisely in the normal position and may be misaligned in the connector width direction X or in the terminal array direction Y. If a misalignment occurs in the connector width direction X, the misalignment is absorbed by resilient deformation of the resilient portions 15 of the plug terminals 10 of the plug connector I in the connector width direction X. If a misalignment occurs in the terminal array direction Y, as can be seen in FIG. 7, the resilient portions 15 of the plug terminals 10 of the plug connector I undergo resilient deformation and absorb this misalignment within the bounds of the gaps 6 (see FIGS. 6(A) and 6(B)) formed relative to the projections 43C within the terminal holding grooves 43B.

In addition, in the present embodiment, the outer long arm portions 15F of the resilient portions 15 of the plug terminals 10 are enabled for resilient deformation within the bounds of the gaps 6 formed relative to the projections 43C in the terminal array direction Y and, meanwhile, are protected against excessive resilient deformation by the projections 43C. Therefore, even if resonance is generated in some of the plug terminals 10 among the multiple plug terminals 10 when the plug connector I matingly connected to the receptacle connector II is subjected to an exterior force and vibrates in the terminal array direction Y, contact between adjacent plug terminals 10 is prevented.

In addition, in the present embodiment, the curved portions 15A of the resilient portions 15 of the plug terminals 10, which are located highest, are located inwardly in the connector width direction X, and the outer long arm portions 15F, extending from these curved portions 15A, are restricted by the projections 43C in terms of resilient deformation in the terminal array direction Y in excess of a predetermined amount. Specifically, the effect of restricting excessive resilient deformation of the resilient portions 15 is enhanced due to the fact that the resilient deformation of the outer long arm portions 15F, which are formed to be the longest arm portions among the multiple arm portions of the resilient portions 15, is restricted by the projections 43C.

Second Embodiment

Figure 8:
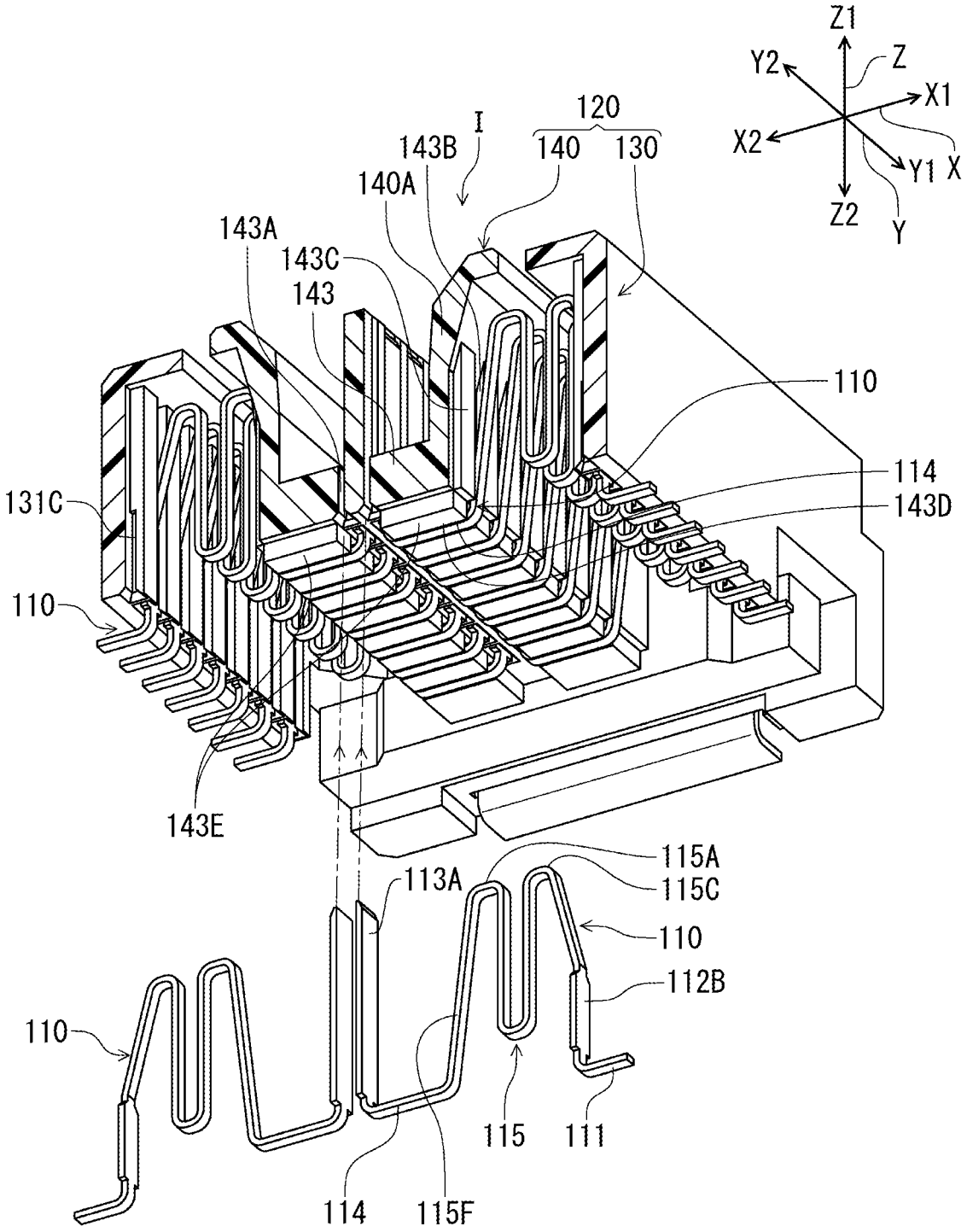
FIG. 8 illustrates a perspective cross-sectional view taken at the location of the terminals, in which the plug connector of the second embodiment of the present invention is viewed from below, with a pair of plug terminals shown removed therefrom.

The second embodiment illustrated in FIG. 8 is different from the first embodiment in which the plug terminals were made by punching sheet metal members in the through-thickness direction, and is characterized by the fact that the plug terminals 110 are made by bending metal strip members in the through-thickness direction, as well as the fact that the bottom projections 143E formed on the bottom face of the bottom wall 143 of the entry wall portion 140A of the movable housing 140 protrude below the plug terminals 110. Other components are similar to those of the first embodiment. Parts corresponding to the first embodiment are assigned reference numerals obtained by adding "100" to the numerals used in the first embodiment, and any overlapping descriptions are omitted.

As can be seen in FIG. 8, the plug terminals 110 are so-called bent terminals obtained by bending metal strip members in the through-thickness direction, which are basically identical to the plug terminals of the first embodiment due to having substantially M-shaped resilient portions 115 between the contact portions 113A and the connecting portions 111. However, the two curved portions 115A and curved portions 115C located in the upper portion of the resilient portions 115 are in the same position in the connector height direction Z, and, in addition, no retained projections are formed on the side edges of the retained arm portions 112B and the movable-side retained portions 113B. The retained arm portions 112B are press-fitted into the stationary-side terminal holding portions 131C of the stationary housing 130 from below and held in place by the opposite side edge portions (edge portions extending in the up-down direction) of the retained arm portions 112B. The movable-side retained portions 113B are press-fitted into the movable-side terminal holding portions 143A of the movable housing 140 from below and held in place by the opposite side edge portions (edge portions extending in the up-down direction) of the movable-side retained portions 113B.

The bottom halves of the outer arm portions 115F of the resilient portions 115 of the plug terminals 110, which are held within the lateral terminal holding grooves 143B (corresponding to the terminal holding grooves 43B of the first embodiment) extending in the connector height direction Z of the movable housing 140, are enabled for resilient displacement (floating) within the bounds of the gaps between them and the lateral projections 143C (corresponding to the projections 43C of the first embodiment) located on opposite sides of the lateral terminal holding grooves 143B in the terminal array direction Y. In addition, in the present embodiment, bottom terminal holding grooves 143D, which extend in the connector width direction X as a continuation of the lateral terminal holding grooves 143B, are formed at locations corresponding to the plug terminals 110 in the terminal array direction Y on the lower face of the bottom wall 143 of the movable housing 140, that is, on the distal end face of the distal end portion facing the circuit board (not shown) in the movable housing 140. The movable-side coupling portions 114 of the plug terminals 110 are accommodated in the bottom terminal holding grooves 143D. In addition, bottom projections 143E are provided between adjacent bottom terminal holding grooves 143D such that a gap is left between them and the plug terminals 110. The bottom projections 143E protrude downwardly beyond the movable-side coupling portions 114 of the plug terminals 110 received in the bottom terminal holding grooves 143D.

Because in the present embodiment the bottom projections 143E protrude farther towards the circuit board than the plug terminals 110, even if the movable housing 140 is acted upon by an exterior force and is downwardly displaced to a considerable extent, the bottom projections 143E abut the circuit board and the movable-side coupling portions 114 of the plug terminals 110 do not make contact with the circuit board.

In addition, in this embodiment, there may or may not be gaps between the bottom projections 143E and the movable-side coupling portions 114. If there are gaps, the movable-side coupling portions 114 are enabled for displacement within the bottom terminal holding grooves 143D in exact proportion to the gaps, and when there are no gaps, the holding force exerted on the plug terminals 110 by the bottom projections 143E is enhanced.

Holding grooves and projections corresponding to the bottom terminal holding grooves 143D and the bottom projections 143E of the present embodiment can also be provided on the bottom face of the bottom wall 43 of the movable housing 40 of the previously described first embodiment.

Although projections (referred to as "bottom projections" hereinbelow) used in order to restrict excessive resilient deformation of the resilient portions of the plug terminals are formed in the lower portion of the movable housing in the first and second embodiment, in addition, projections (referred to as "top projections" hereinbelow) used in order to restrict excessive resilient deformation of the resilient portions may also be provided in the upper portion of the movable housing. For example, the curved portions of the resilient portions that are located upwardly in the connector height direction and innermost in the connector width direction can be provided with top projections located on opposite sides in the terminal array direction to thereby restrict resilient deformation of the curved portions in the terminal array direction with these top projections. Providing both bottom projections and top projections in this manner enhances the effect of restricting excessive resilient deformation of the resilient portions. In addition, even if the top projections are provided in this manner, when the plug terminals are incorporated into the movable housing from below in the process of plug connector manufacture, the resilient portions of said plug terminals are guided by the bottom projections and, at the same time, the upper curved portions of said resilient portions enter between the top projections. That is to say, since during the incorporation step the position of the plug terminals is already determined to a certain degree, the upper curved portions of the resilient portions do not collide with the top projections and the plug terminals can be incorporated in a simple and reliable manner.

Although examples of application of the present invention to a plug connector I, in which the connector height direction Z perpendicular to the mounting face of the circuit board is the direction of connection to the receptacle connector II, have been illustrated in the first and second embodiment, the connectors, to which the present invention can be applied, are not limited thereto. For example, the present invention can be applied to so-called right-angle connectors, in which the direction of connection to a counterpart connect body is a direction parallel to the mounting face of the circuit board.

Although examples where the counterpart connect body connected to the connector, to which the present invention applies, is a counterpart connector, have been illustrated in the first and second embodiment, the configuration of the counterpart connect body is not limited thereto and, for example, a circuit board connected to the connector may be a counterpart connect body.

DESCRIPTION OF THE REFERENCE NUMERALS

10 Plug terminals
11 Connecting portion
12 Stationary-side retained portion
13A Contact portion
13B Movable-side retained portion
15A, 15B, 15C Curved portions
20 Housing
30 Stationary housing
30A Interior space
40 Movable housing
40A Entry wall portion
43A Movable-side terminal holding portion
43B Terminal holding groove
43C Projection
110 Plug terminal
112B Stationary-side retained portion
113A Contact portion
115 Resilient portion
115A, 115B, 115C Curved portions
130 Stationary housing
140 Movable housing
140A Entry wall portion
143A Movable-side terminal holding portion
143B Lateral terminal holding groove
143C Lateral projection
143D Bottom terminal holding groove
143E Bottom projection
δ Gaps

The invention claimed is:

1. An electrical connector for circuit boards comprising:

terminals comprising connecting portions configured to connect to a circuit board formed at one end and contact portions configured to contact a counterpart connect body formed at an other end thereof; and a housing in which the terminals are secured therein such that a terminal array direction is a direction parallel to a surface of the circuit board, said housing having a stationary housing, configured to attach to the circuit board via the connecting portions of the terminals, and a movable housing, configured to move relative to said stationary housing and having the contact portions of the terminals disposed therein, the stationary housing having an interior space formed to permit entry of the movable housing in a direction of connection to the counterpart connect body, wherein the terminals further comprise a stationary-side retained portion secured in the stationary housing by press-fitting, a movable-side retained portion secured in the movable housing by press-fitting, and a resiliently deformable resilient portion located between said stationary-side retained portion and said movable-side retained portion, wherein the movable housing comprises an entry wall portion that enters the interior space of the stationary housing and is located in a spaced-apart relationship with said stationary housing, terminal holding grooves that extend in the direction of connection and configured to accommodate a portion of the resilient portions, the terminal holding grooves formed so as to be arranged in the terminal array direction on one wall surface of said entry wall portion, and movable-side terminal holding portions securing movable-side retained portions of the terminals are formed on an opposite side in a connector width direction perpendicular to said one wall surface, wherein between the adjacent terminal holding grooves, the movable housing comprises projections that extend in the direction of connection from a distal end portion facing the circuit board side of the entry wall portion, and, when the terminals are attached in the direction of connection from a circuit board side, the projections have gaps formed between them and the resilient portions of the terminals are located within the terminal holding grooves in the terminal array direction, wherein said movable-side retained portion includes the movable-side coupling portions, each extending outwardly in the connector width direction from a side edge portion of a bottom portion of said movable-side retained portion and being coupled to the resilient portions of the terminals, such that the resilient portions of the terminals emerge from the movable-side coupling portions, wherein the resilient portions of the terminals comprise a plurality of curved portions and outer arm portions, each extending between one of the curved portions and one of the movable-side coupling portions, wherein each of the projections is disposed between the adjacent outer arm portions, such that said each of the projections is located between the adjacent movable-side coupling portions, and wherein, during incorporation of the terminals into the movable housing, in a direction of the incorporation, the resilient portions are coupled to the movable-side retained portions by the movable-side coupling portions of the terminals with an offset in the connector width direction, the movable-side retained portions are retained in movable-side terminal retaining portions on one face of a bottom wall of the movable housing, and the resilient portions are held in the terminal holding grooves on another face of the bottom wall of the movable housing.

2. The electrical connector for circuit boards according to claim 1, wherein the resilient portions of the terminals comprise a wavelike configuration with the plurality of curved portions in a space between the stationary housing and the movable-side terminal holding portions of the movable housing, and the curved portions located closest to the movable-side terminal holding portions in the connector width direction are located farthest from the circuit board in the direction of connection.

3. The electrical connector for circuit boards according claim 1, wherein the movable housing has the terminal holding grooves and the projections formed on a distal end face of the distal end portion facing the circuit board, and the projections on the distal end face protrude beyond the terminals towards the circuit board.

* * * * *